US012668404B2

(12) United States Patent
Lin

(10) Patent No.: US 12,668,404 B2
(45) **Date of Patent: *Jun. 30, 2026**

(54) LID STRUCTURE

(71) Applicant: Shenzhen Zhongmin Technology Co., Ltd., Shenzhen (CN)

(72) Inventor: Yitong Lin, Shenzhen (CN)

(73) Assignee: Shenzhen Zhongmin Technology Co., Ltd., Shenzhen (CN)

( * ) Notice: Subject to any disclaimer, the term of this patent is extended or adjusted under 35 U.S.C. 154(b) by 205 days.

This patent is subject to a terminal disclaimer.

(21) Appl. No.: 18/645,361

(22) Filed: Apr. 24, 2024

(65) Prior Publication Data

US 2025/0162768 A1 May 22, 2025

(30) Foreign Application Priority Data

Nov. 22, 2023 (CN) ..... 202311563920.X

(51) Int. Cl.
*B65D 47/06* (2006.01)

(52) U.S. Cl.
CPC ..... *B65D 47/066* (2013.01); *B65D 2547/063* (2013.01)

(58) Field of Classification Search
CPC ..... B65D 47/066; B65D 2547/063; B65D 47/32; A47G 19/2272
See application file for complete search history.

(56) References Cited

U.S. PATENT DOCUMENTS

| | | | | |
|---|---|---|---|---|
| 10,455,959 | B2 * | 10/2019 | Coon | B65D 47/0871 |
| 11,479,390 | B1 * | 10/2022 | Salvador-Zamora | B65D 47/0857 |
| 12,479,632 | B2 * | 11/2025 | Lin | B65D 47/066 |
| 2012/0187075 | A1 * | 7/2012 | El-Saden | B65D 51/242 215/389 |
| 2022/0033148 | A1 * | 2/2022 | Filiau | B65D 47/305 |
| 2025/0162768 | A1 * | 5/2025 | Lin | B65D 47/066 |

FOREIGN PATENT DOCUMENTS

| | | | | |
|---|---|---|---|---|
| CN | 208783891 U | * | 4/2019 | |
| CN | 209610698 U | * | 11/2019 | |
| EP | 3009053 A1 | * | 4/2016 | A45F 3/16 |

* cited by examiner

*Primary Examiner* — Bob Zadeh
(74) *Attorney, Agent, or Firm* — JEEN IP LAW, LLC

(57) ABSTRACT

Disclosed is a lid structure, which includes a main lip, an upper lid and a locking assembly, the main lid is provided with a straw, an inserting and locking portion is disposed on the straw, the upper lid is buckled to the main lid, the upper lid is provided with an opening for the straw to extend out, the locking assembly is disposed between the main lid and the upper lid, and when the straw is bent, the locking assembly can move along a radial direction of the main lid to be inserted and locked with the inserting and locking portion. In the present disclosure, a manner that the locking assembly is matched with the inserting and locking portion on the straw is adopted when there is no need to drink water, so that the straw can be kept bent all the time, which avoids liquid leakage.

12 Claims, 13 Drawing Sheets

LID STRUCTURE

CROSS REFERENCES TO RELATED APPLICATION

The present application claims the benefit of Chinese Patent Application No. 202311563920.X filed on Nov. 22, 2023, the contents of which are incorporated herein by reference in their entirety.

TECHNICAL FIELD

The present disclosure relates to the technical field of manufacturing of water bottles, in particular to a lid structure for water bottle.

BACKGROUND ART

Currently, for most of water bottles in the market, an upper lid is sprang open by a front button, and the upper lid is closed to press against a straw to be bent. In a manner of sealing water by such a structure, the upper lid will be pressed for a long term, which easily results in displacement and deformation of the upper lid, and therefore, the structure will result in water leakage when used for a long term.

SUMMARY OF THE INVENTION

The present disclosure aims to provide a lid structure to solve the technical problem that the current water bottle lid is poor in water sealing effect when used for a long term.

In order to solve the above problem, according to one aspect of the present application, an embodiment of the present disclosure provides a lid structure. The lid structure includes:

- a main lid provided with a straw, an inserting and locking portion being disposed on a side wall of the straw;
- an upper lid buckled to the main lid, the upper lid being provided with an opening for the straw to extend out; and
- a locking assembly disposed between the main lid and the upper lid, wherein when the straw is bent, the locking assembly is capable of moving along a radial direction of the main lid to be inserted and locked with the inserting and locking portion, and the locking assembly is separable from the inserting and locking portion so as to be unlocked when pressed.

In some implementations, the locking assembly includes a puller, a locking pin and a first elastic member, the puller is rotatably disposed on an outer wall of the main lid, the locking pin is disposed between the main lid and the upper lid in a radially movable manner, one end of the locking pin penetrates out of the main lid and is rotatably connected to the puller, and the first elastic member is disposed between the puller and the main lid to drive the locking pin to move inwards along the radial direction.

In some implementations, a first buckling member and a second buckling member are buckled on the periphery of the straw, the inserting and locking portion is disposed on the first buckling member or the second buckling member, is located on a side, facing the puller, of the straw, and is provided with an inserting hole, when the straw is bent, the locking pin is inserted and locked in the inserting hole along a radial direction of the main lid, and when the puller is pressed, the locking pin is withdrawn from the inserting hole.

In some implementations, a first rotating shaft is disposed on an outer wall of the first buckling member or the second buckling member, the main lid is provided with a first supporting portion extending to the upper lid, and an end portion of the first supporting portion and/or the upper lid is provided with a first mounting groove for the first rotating shaft to be inserted.

In some implementations, a first hook is disposed on an opening portion, facing to the second buckling member, of the first buckling member, a second hook is disposed on an opening portion, facing to the first buckling member, of the second buckling member, and the first hook is hung and locked with the second hook; and/or a toggle convex edge is disposed on the periphery of the first buckling member or the second buckling member, and the toggle convex edge is located on a side, away from the locking assembly, of the straw and is located outside the opening.

In some implementations, the main lid is provided with a protective structure, and the protective structure is disposed around the puller; and/or, a safety latch is further disposed between the main lid and the upper lid, the safety latch is provided with a toggle protrusion protruding out of the upper lid, and the locking pin is provided with a locking hole for the safety latch to be inserted and locked when the straw is bent.

In some implementations, the opening is rotatably provided with a dust cover, an opening direction of the dust cover is opposite to a bending direction of the straw, the dust cover is provided with a toggle portion abutting against the dust cover when the straw is bent, so as to be matched with the straw to close the opening, and the straw and the puller are disposed on two sides of the dust cover.

In some implementations, the main lid is provided with an air inlet, a plugging valve is disposed on a side, facing the upper lid, of the air inlet, and when the locking assembly is inserted and locked with the inserting and locking portion, the straw is capable of forcing the plugging valve to close the air inlet.

In some implementations, a mounting pipe surrounding the air inlet is disposed on a side, facing the upper lid, of the main lid, the plugging valve includes a plugger, a clamping portion and a third elastic member, an inner wall of the mounting pipe is provided with an annular blocking portion, the clamping portion and the plugger are connected and are sequentially mounted in the mounting pipe from an opening portion away from the main lid, the third elastic member is clamped between the clamping portion and the main lid, an annular hanging portion is disposed on the periphery of the clamping portion and is located on a side, facing the main lid, of the annular blocking portion, and an external diameter of the annular hanging portion is greater than an internal diameter of the annular blocking portion.

In some implementations, an end portion, facing the main lid, of the clamping portion is provided with an inserting pipe, the annular hanging portion is disposed on the periphery of the inserting pipe, the inserting pipe is provided with a plurality of shrinkage grooves extending in an axial direction, the shrinkage grooves extend from an end portion, facing the main lid, of the inserting pipe to a side, away from the main lid, of the annular hanging portion, and the shrinkage grooves penetrate through the annular hanging portion.

Compared with the prior art, the lid structure of the present disclosure at least has the following beneficial effects:

- the embodiments of the present disclosure disclose the lid structure. The lid structure includes the main lid, the upper lid and the locking assembly, the upper lid is provided with the straw, the inserting and locking portion is disposed on the side wall of the straw, the upper lid is buckled to the main lid, the upper lid is provided with the opening for the straw to extend out, the locking assembly is disposed between the main lid and the upper lid, and when the straw is bent, the locking assembly is capable of moving along the radial direction of the main lid to be inserted and locked with the inserting and locking portion. Specifically, when the straw is bent, the straw is plugged, which can avoid water leakage. Due to the fact that when the straw is bent, the locking assembly is capable of moving along the radial direction of the main lid to be inserted and locked with the inserting and locking portion, a situation that the straw gets upright due to a bouncing force thereof to result in water leakage is avoided. In addition, the locking assembly is separable from the inserting and locking portion so as to be unlocked when pressed, so that one-button opening for drinking water can be achieved. Compared with a current manner adopted in the market that the upper lid is closed to press against the straw to be bent to seal water, in the present disclosure, a manner that the locking assembly is matched with the inserting and locking portion on the side wall of the straw is adopted when there is no need to drink water, so that the straw can be kept bent all the time, which avoids liquid leakage, and the problem of water leakage resulted from displacement and deformation of the upper lid, which are easily resulted from current long-term pressing the upper lid against the straw, is solved; and the lid structure of the present disclosure is convenient and simple to use, which improves the user experience.

The above description is only an overview of the technical solutions of the present disclosure. In order to more clearly understand the technical means of the present disclosure and implement them in accordance with the contents of the specification, the preferred embodiments of the present disclosure and the accompanying drawings are described in detail as follows.

BRIEF DESCRIPTION OF THE DRAWINGS

In order to more clearly illustrate the technical solutions of the embodiments of the present disclosure, accompanying drawings that are to be referred for description of the embodiments will be briefly described hereinafter. Apparently, the drawings described hereinafter illustrate some embodiments of the present disclosure, and a person of ordinary skill in the art may also derive other drawings based on the drawings described herein without any creative effort.

DESCRIPTION OF REFERENCE NUMERALS

Figure 1:
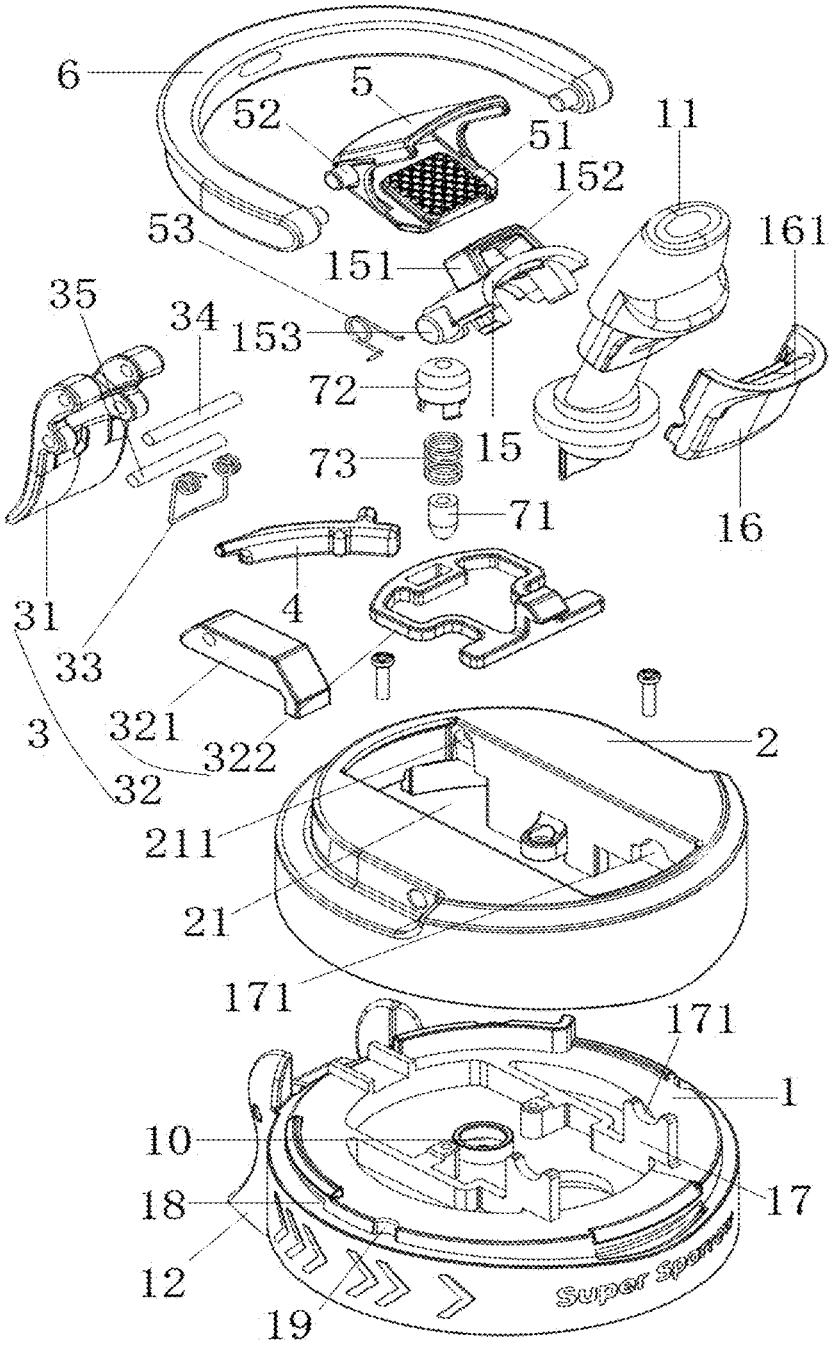
FIG. 1 is a schematic three-dimensional exploded structure diagram of a lid structure according to an embodiment of the present disclosure.

1. main lid; 10. air inlet; 11. straw; 12. protective structure; 13. first toggle point groove; 14. second toggle point groove; 15. first buckling member; 151. inserting and locking portion; 152. inserting hole; 153. first rotating shaft; 154. first hook; 16. second buckling member; 161. toggle convex edge; 162. second hook; 17. first supporting portion; 171. first mounting groove; 18. buckling groove; 19. anti-rotation groove; 20. mounting pipe; 201. annular blocking portion;

2. upper lid; 21. opening; 211. second mounting groove; 22. buckling protrusion; 23. anti-rotation protrusion;

3. locking assembly; 31. puller; 32. locking pin; 321. first subsection; 322. second subsection; 323. locking hole; 324. avoidance hole; 325. hanging tongue; 33. first elastic member; 34. first hinge pin; 35, second hinge pin;

4. safety latch; 41. toggle protrusion; 42. toggle point;

5. dust cover; 51. toggle portion; 52. second rotating shaft; 53. second elastic member;

6. carry handle;

7. plugging valve; 71. plugger; 72. clamping portion; 721. annular hanging portion; 722. inserting pipe; 723. shrinkage groove; 73. third elastic member.

DETAILED DESCRIPTION OF THE INVENTION

In order to further explain the technical means and effects adopted by the present disclosure to achieve the intended inventive purpose, the specific implementations, structures, features, and effects according to the present application are described in detail below in connection with the accompanying drawings and preferred embodiments. In the following description, different "an embodiment" or "embodiments" do not necessarily refer to the same embodiment. Furthermore, particular features, structures, or characteristics of one or more embodiments may be combined in any suitable form.

In the description of the present disclosure, it is to be clarified that the terms "first", "second", etc. in the specification and claims of the present disclosure and the above accompanying drawings are used for distinguishing similar objects, and need not be used for describing a particular order or sequence; the terms "vertical", "transverse", "longitudinal", "front", "rear", "left", "right", "upper", "lower", "horizontal" and the like indicate orientation or positional relationships based on those shown in the accompanying drawings, merely for the purpose of facilitating the description of the present disclosure, and do not imply that the device or element referred to must have a characteristic orientation or position, and therefore are not to be construed as a limitation of the present disclosure.

In the description of the present disclosure, it is to be noted that, unless otherwise expressly provided and limited, the terms "mounted", "connected", and "connecting" are to be understood in a broad sense, e.g., it may be a fixed connection or a detachable connection or an integrated connection; it may be a mechanical connection or an electrical connection; and it may be a direct connection or an indirect connection through an intermediate medium. The specific meanings of the above terms in the present disclosure may be understood in specific situations by a person of ordinary skill in the art.

Figure 2:
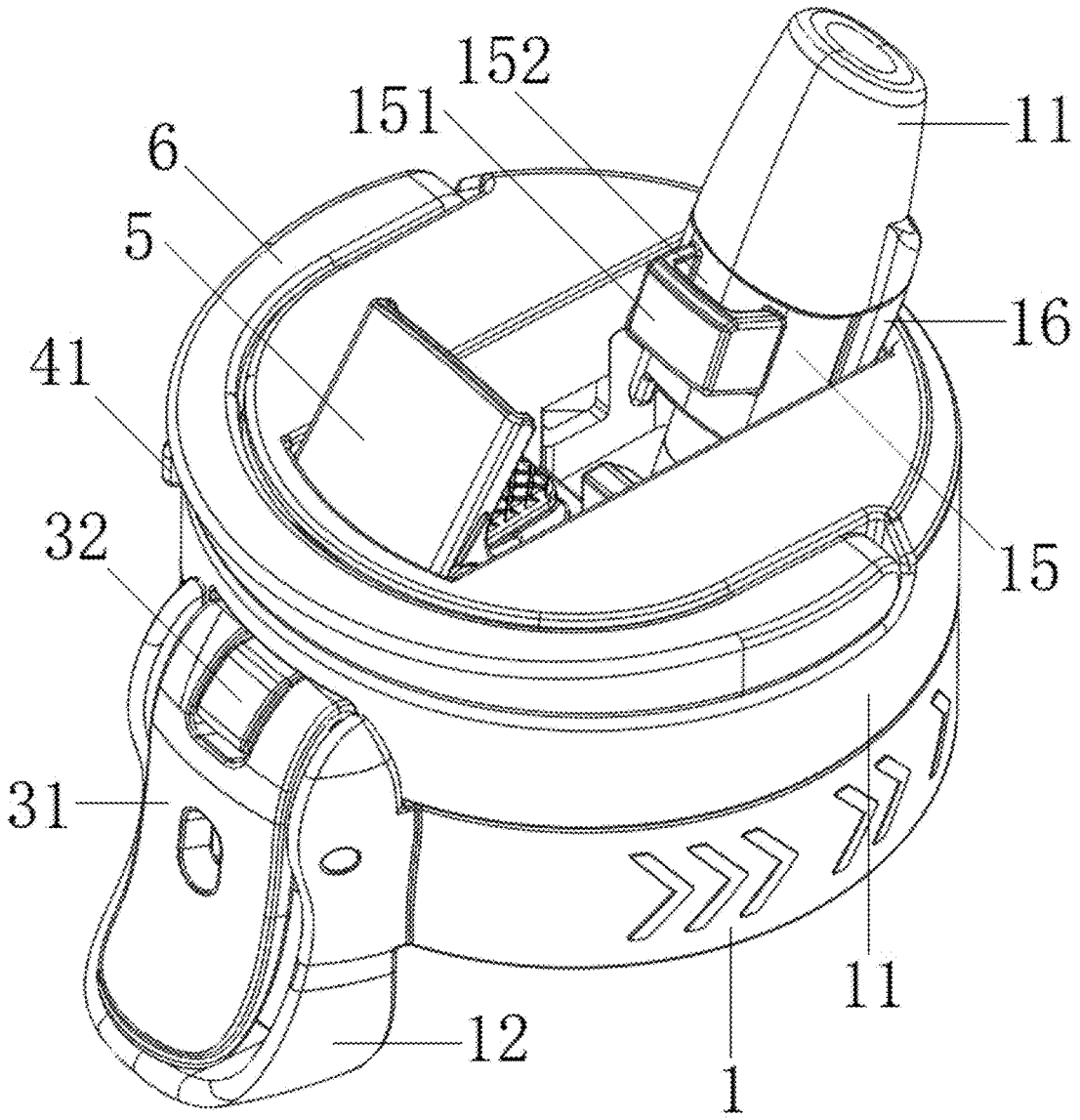
FIG. 2 is a schematic structural diagram of a lid structure according to an embodiment of the present disclosure.
Figure 3:
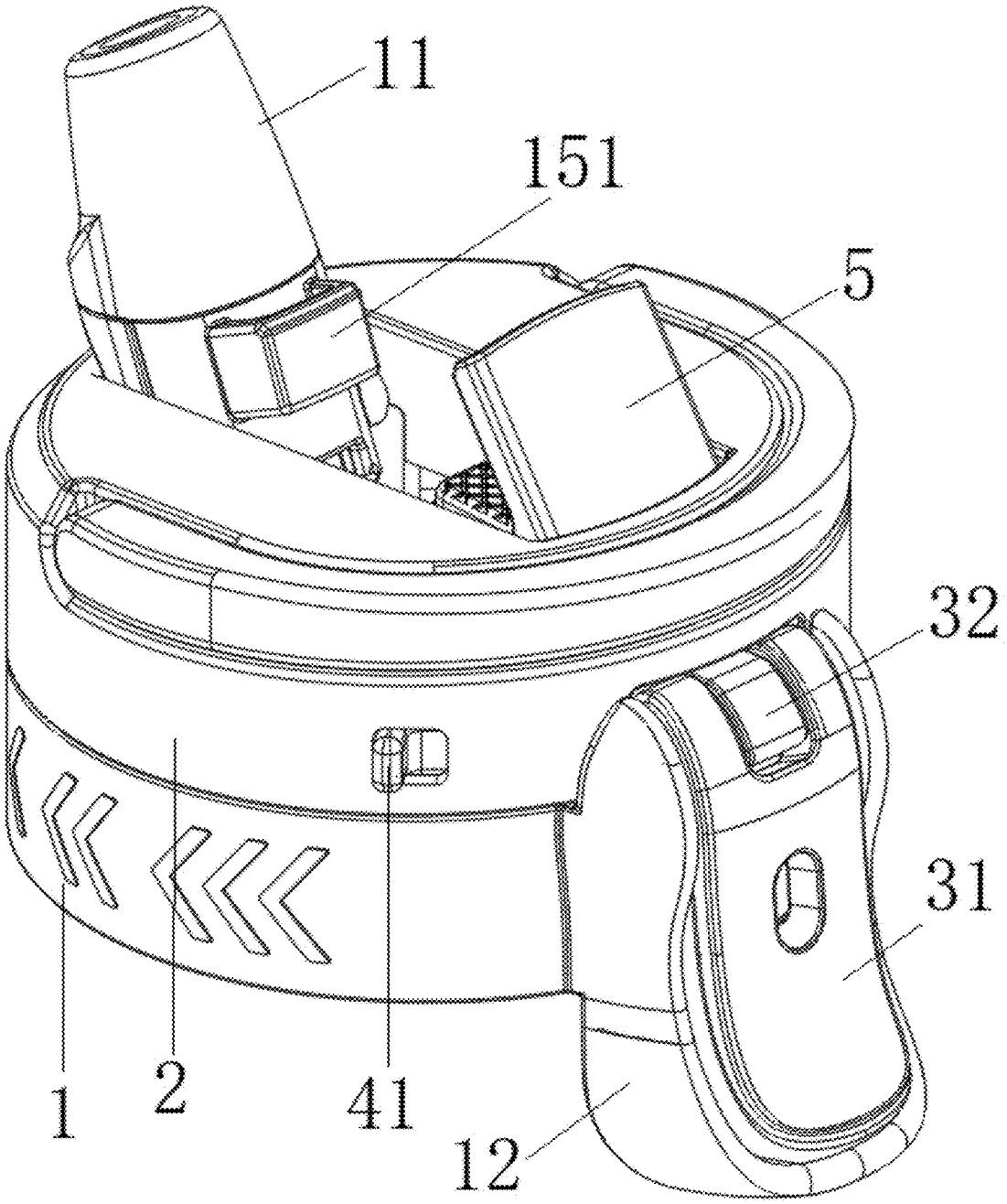
FIG. 3 is a schematic structural diagram of a lid structure from another viewing angle according to an embodiment of the present disclosure.
Figure 4:
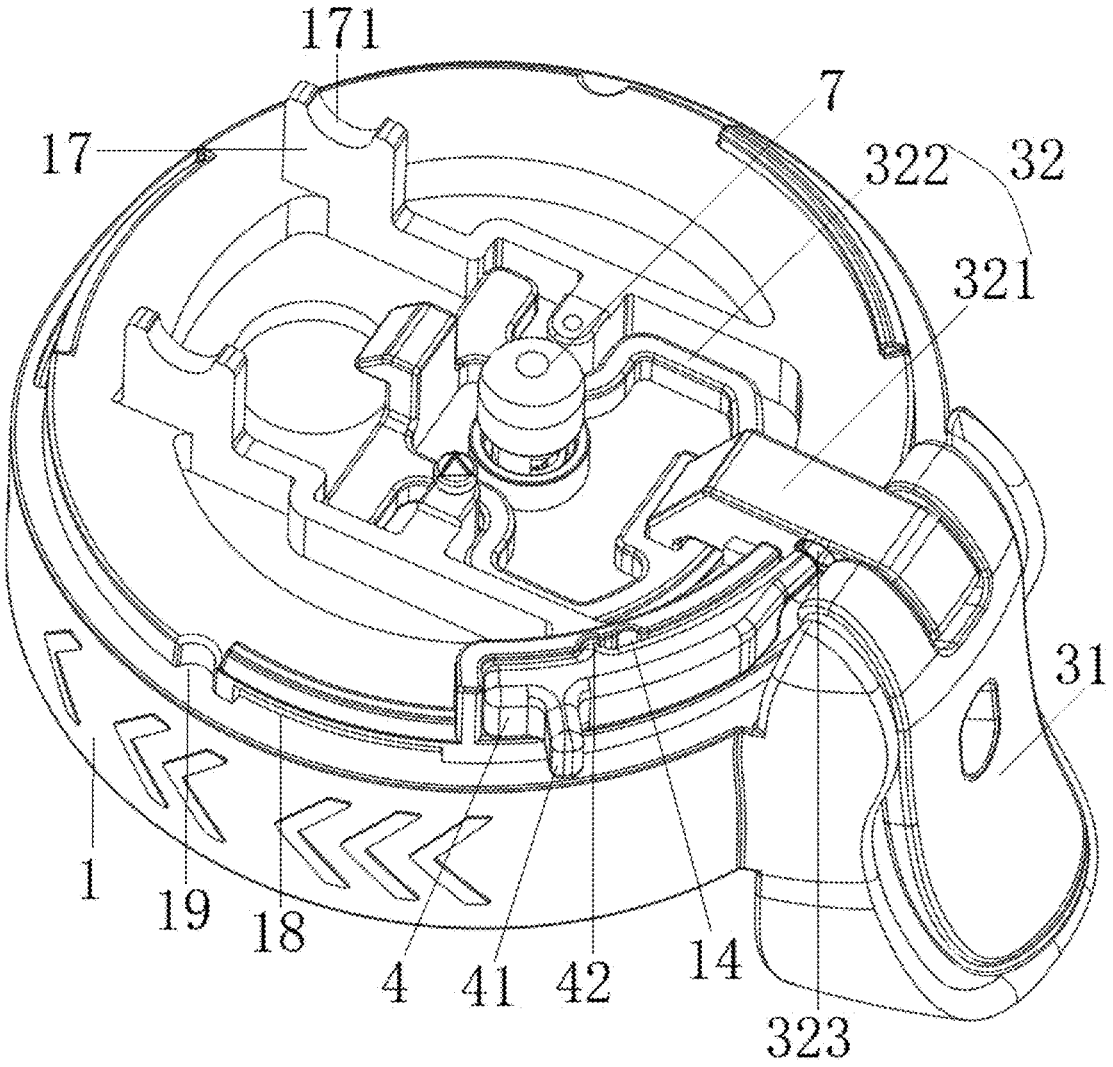
FIG. 4 is a schematic structural diagram of a safety latch of a lid structure according to an embodiment of the present disclosure when located outside a locking hole; cross-sectional view of a lid structure according to an embodiment of the present disclosure.
Figure 5:
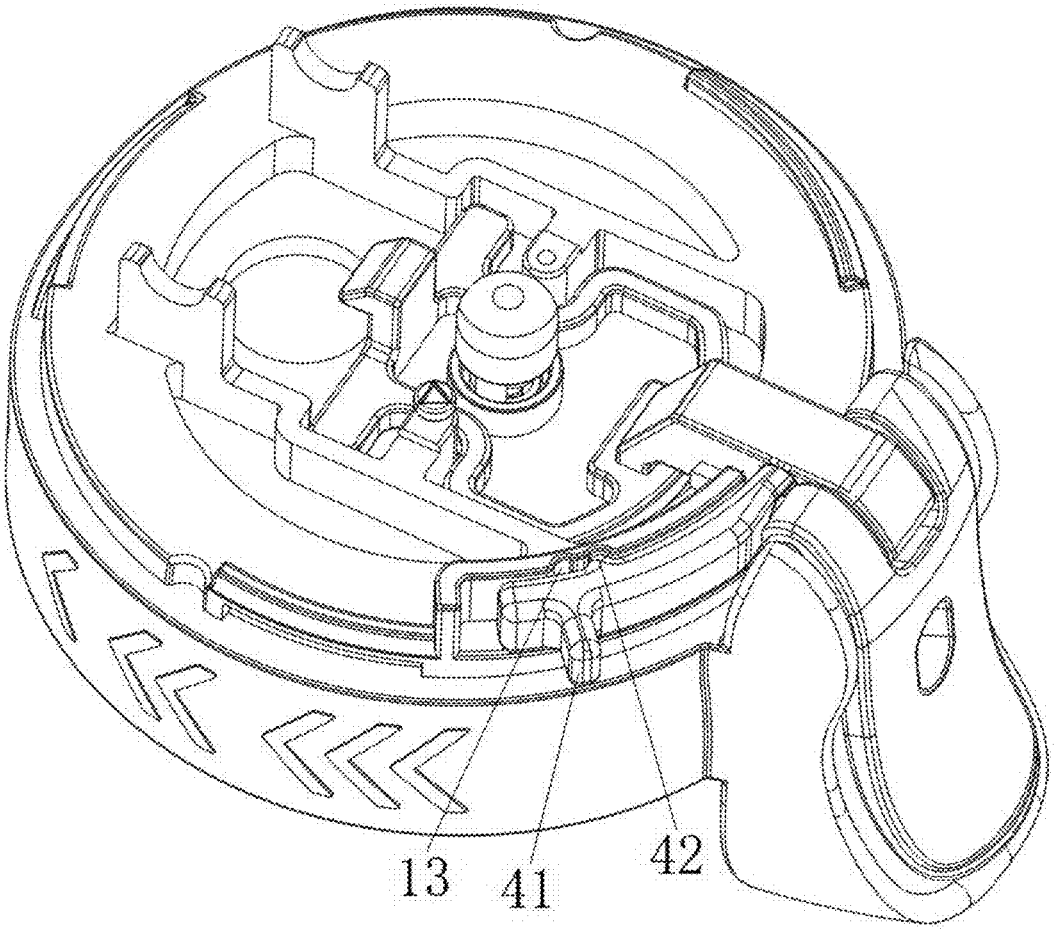
FIG. 5 is a schematic structural diagram of a safety latch of a lid structure according to an embodiment of the present disclosure when inserted in a locking hole.
Figure 6:
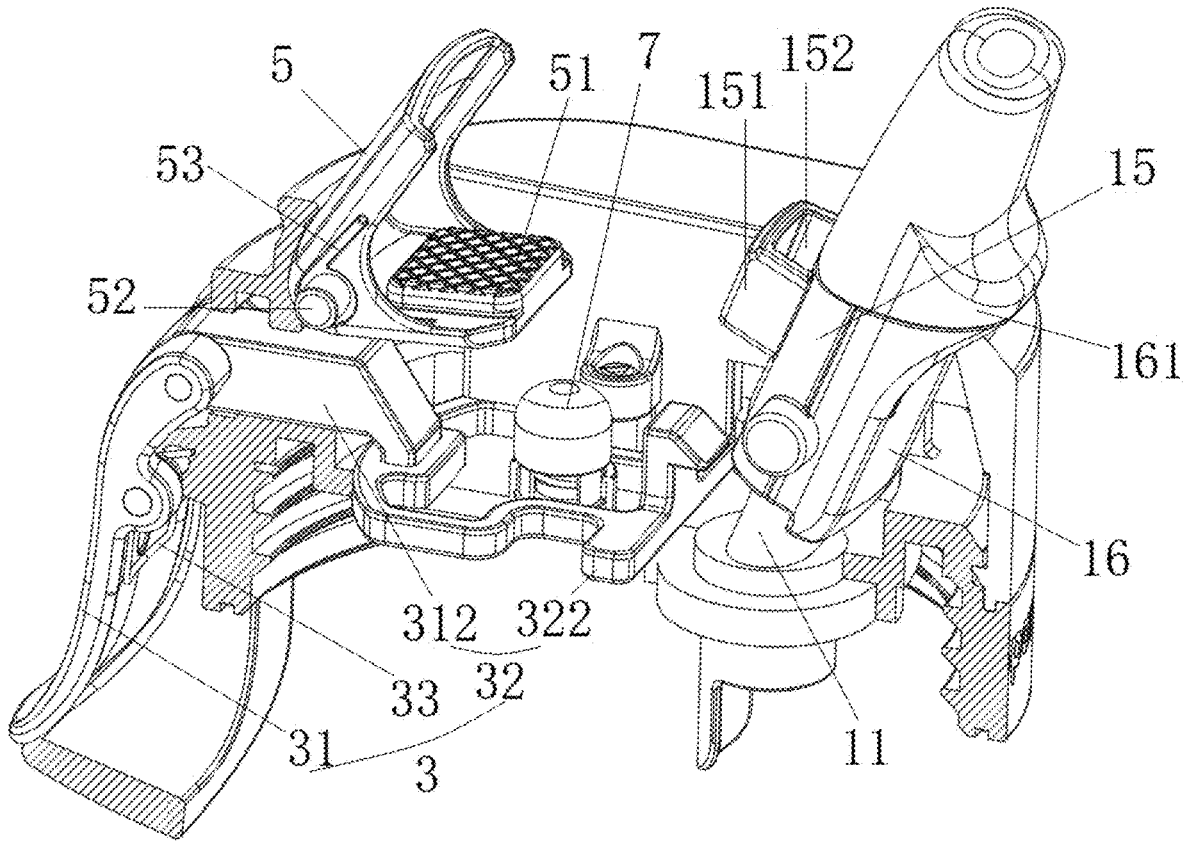
FIG. 6 is a three-dimensional cross-sectional view of a lid structure according to an embodiment of the present disclosure.
Figure 7:
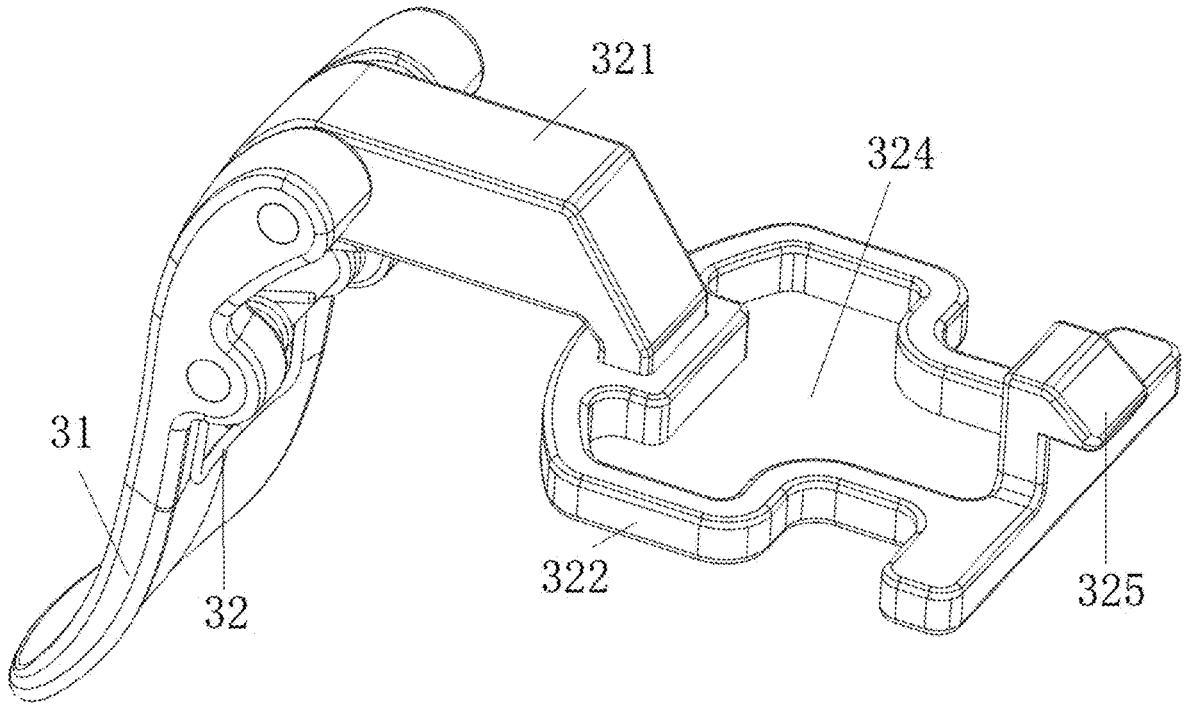
FIG. 7 is a schematic structural diagram of a locking assembly of a lid structure according to an embodiment of the present disclosure.
Figure 8:
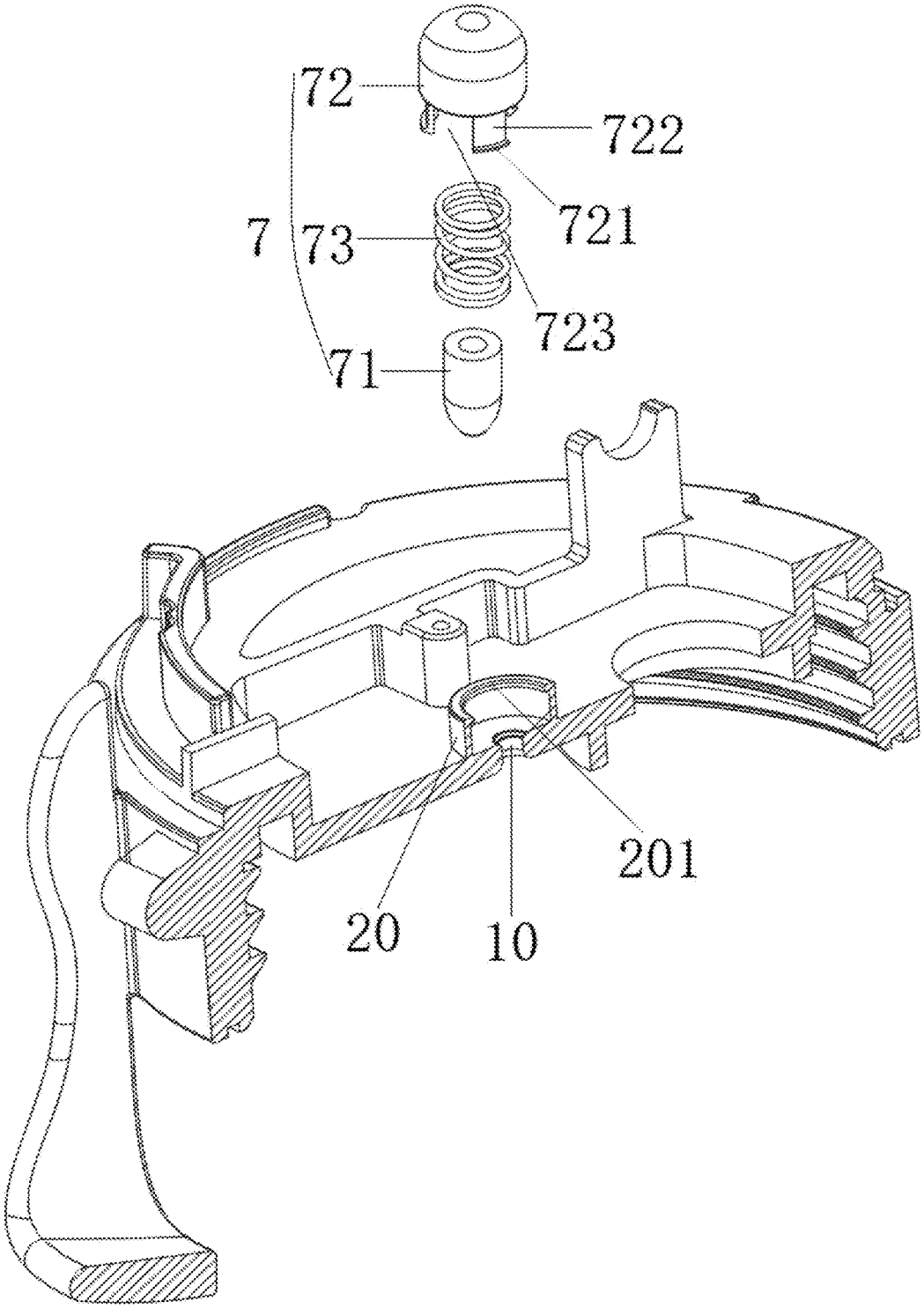
FIG. 8 is a schematic exploded structure diagram of a plugging valve and a main lid of a lid structure according to an embodiment of the present disclosure.
Figure 9:
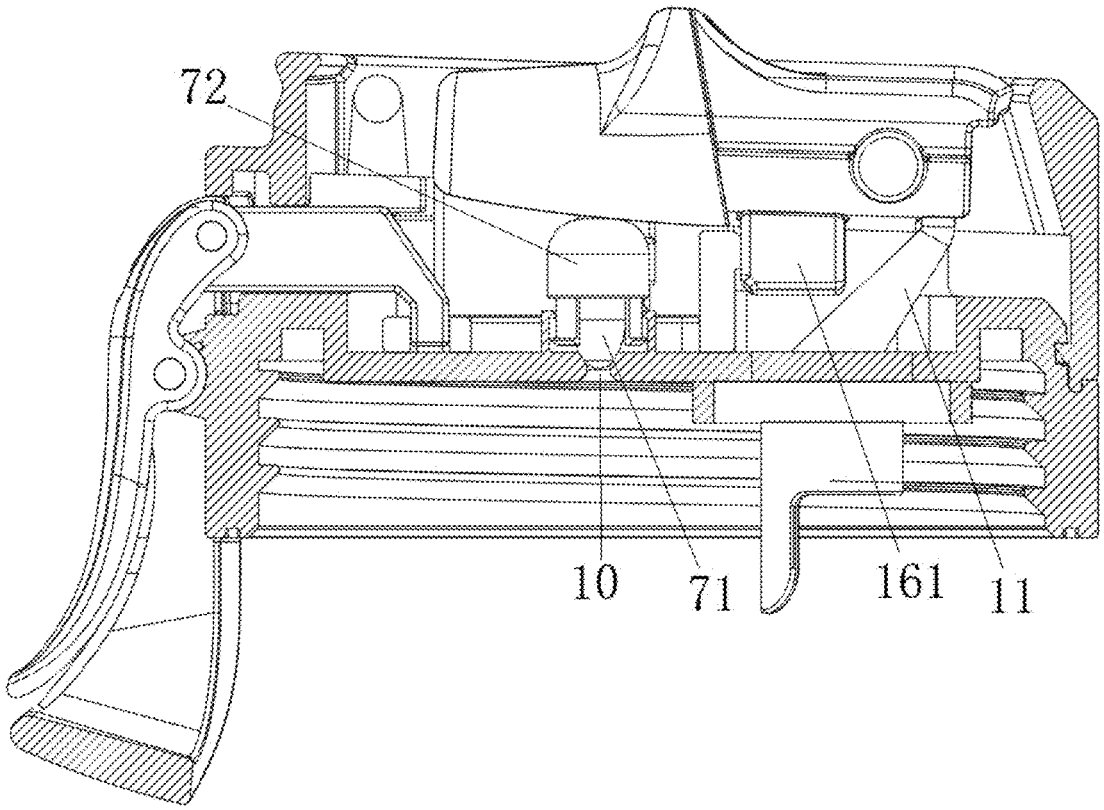
FIG. 9 is a schematic structural diagram of a plugging valve of a lid structure according to an embodiment of the present disclosure when plugging an air inlet.
Figure 10:
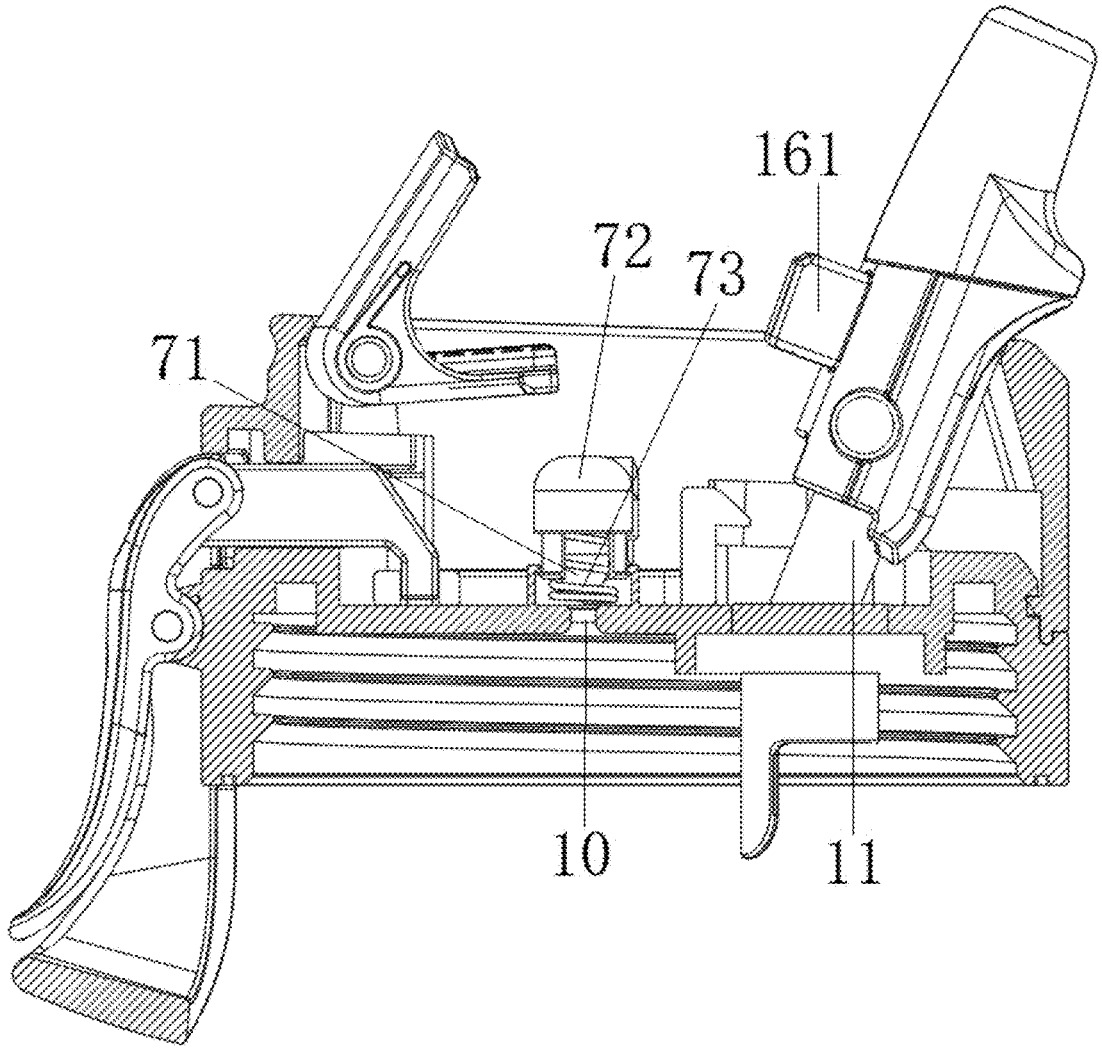
FIG. 10 is a schematic structural diagram of a plugging valve of a lid structure according to an embodiment of the present disclosure when opening an air inlet.
Figure 11:
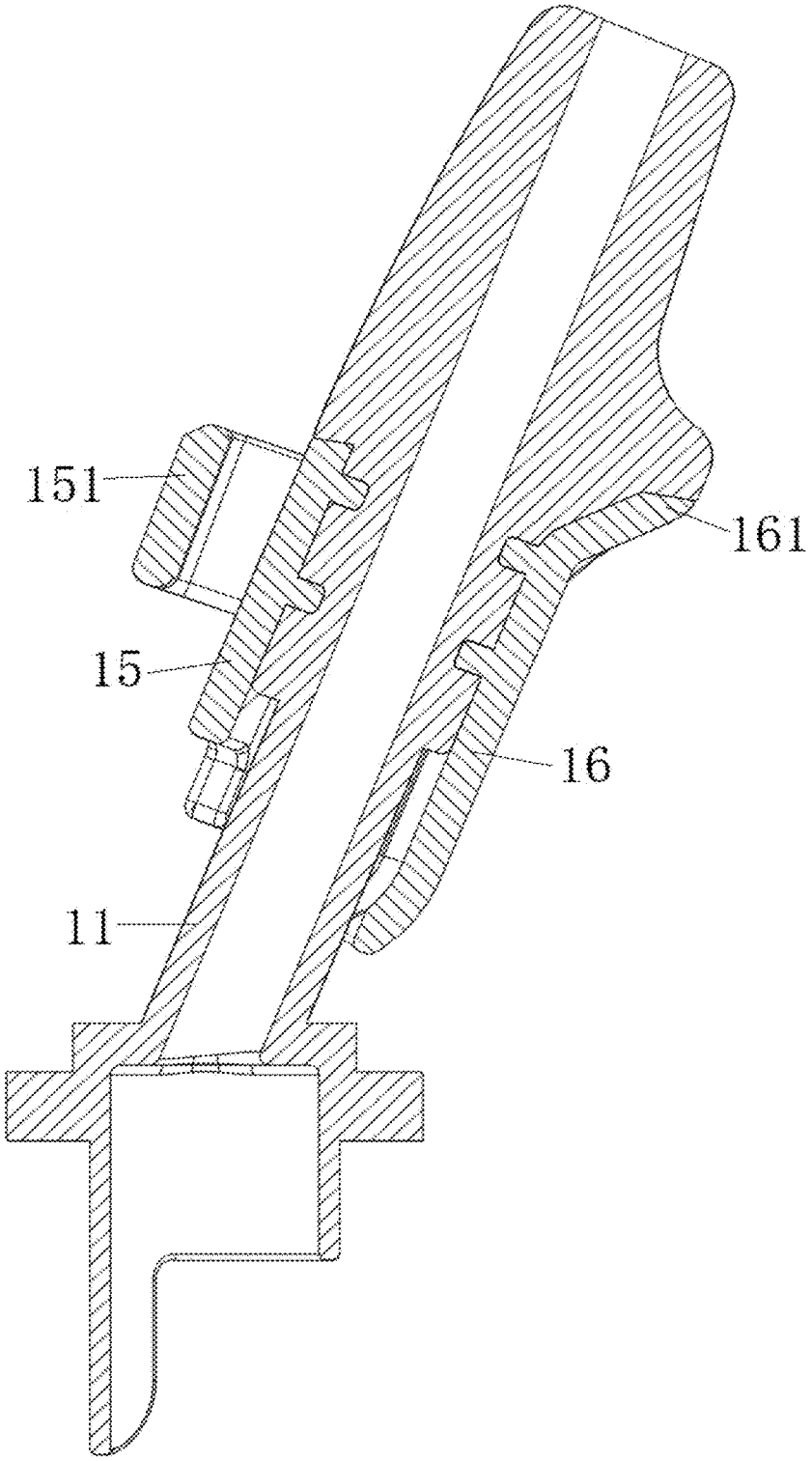
FIG. 11 is a cross-sectional view of a straw, a first buckling member and a second buckling member of a lid structure according to an embodiment of the present disclosure after assembled.
Figure 12:
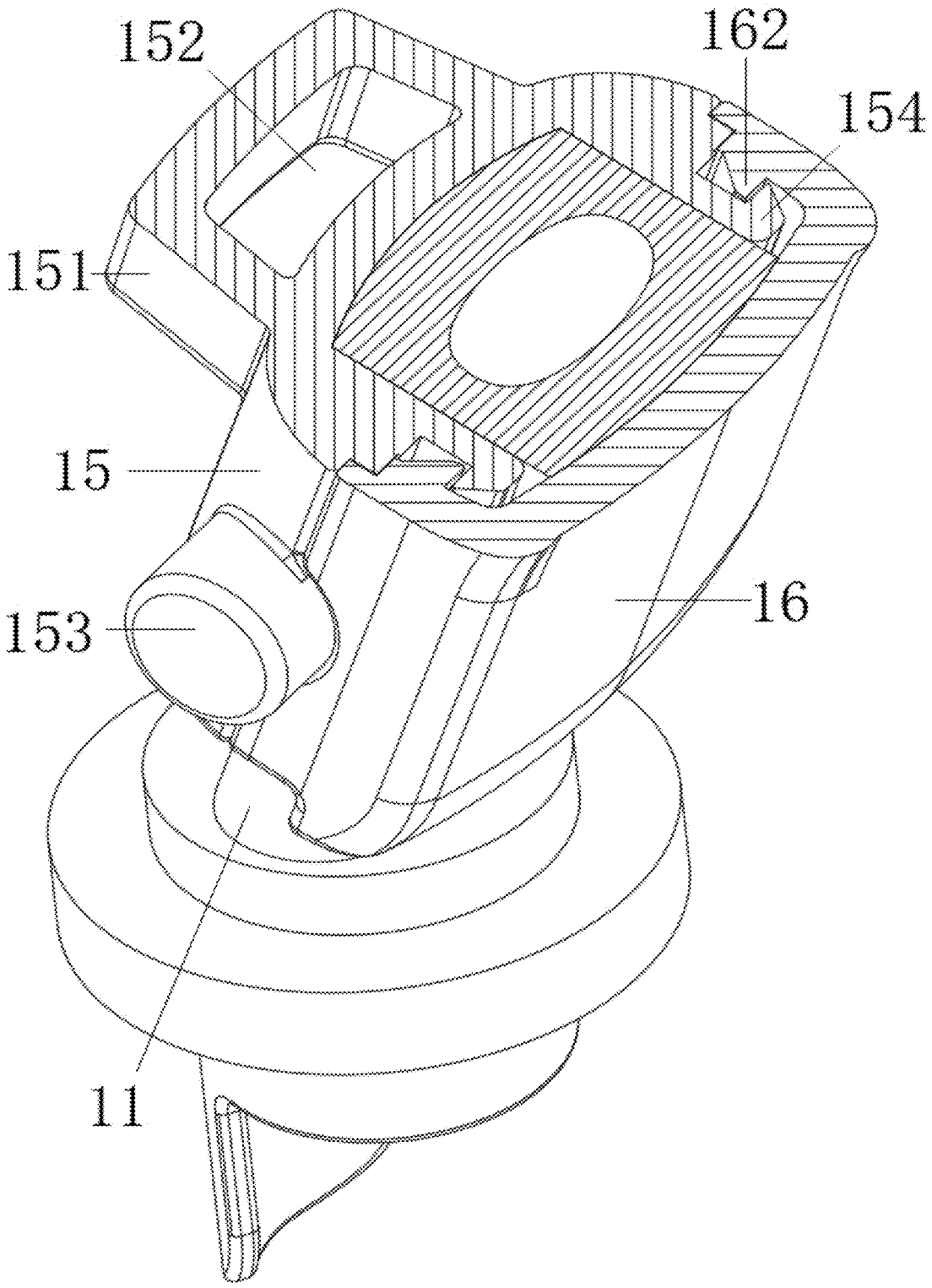
FIG. 12 is a cross-sectional view of another direction of a straw, a first buckling member and a second buckling member of a lid structure according to an embodiment of the present disclosure after assembled.
Figure 13:
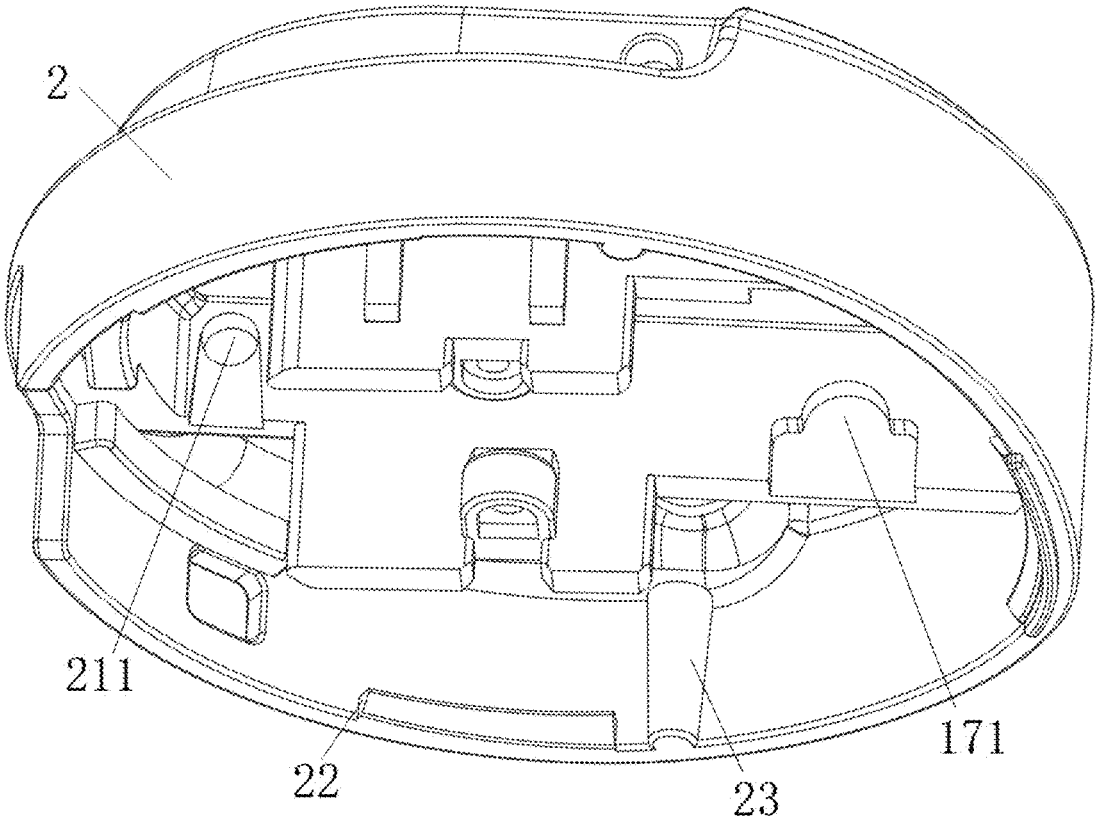
FIG. 13 is a schematic structural diagram of an upper lid of a lid structure according to an embodiment of the present disclosure.

As shown in FIGS. 1-13, an embodiment of the present disclosure provides a lid structure. The lid structure includes:

- a main lid 1 provided with a straw 11, an inserting and locking portion 151 being disposed on a side wall of the straw 11;
- an upper lid 2 buckled to the main lid 1, the upper lid 2 being provided with an opening 21 for the straw 11 to extend out; and
- a locking assembly 3 disposed between the main lid 1 and the upper lid 2, wherein when the straw 11 is bent, the locking assembly 3 is capable of moving along a radial direction of the main lid 1 to be inserted and locked with the inserting and locking portion 151, and the locking assembly 3 is separable from the inserting and locking portion so as to be unlocked 151 when pressed.

In this embodiment, the lid structure includes the main lid 1, the upper lid 2 and the locking assembly 3, the main lid 1 is provided with the straw 11, the inserting and locking portion 151 is disposed on the side wall of the straw 11, the upper lid 2 is buckled to the main lid 1, the upper lid 2 is provided with the opening 21 for the straw 11 to extend out, the locking assembly 3 is disposed between the main lid 1 and the upper lid 2, and when the straw 11 is bent, the locking assembly 3 is capable of moving along the radial direction of the main lid 1 to be inserted and locked with the inserting and locking portion 151. Specifically, when the straw 11 is bent, the straw 11 is plugged, which can avoid water leakage. In this embodiment, due to the fact that when the straw 11 is bent, the locking assembly 3 is capable of moving along the radial direction of the main lid 1 to be inserted and locked with the inserting and locking portion 151, a situation that the straw 11 gets upright due to a bouncing force thereof to result in water leakage is avoided. In addition, the locking assembly 3 is separable from the inserting and locking portion so as to be unlocked 151 when pressed, so that one-button opening for drinking water can be achieved. Compared with a current manner adopted in the market that the upper lid is closed to press against the straw 11 to be bent to seal water, in this embodiment, a manner that the locking assembly 3 is matched with the inserting and locking portion 151 on the side wall of the straw 11 is adopted when there is no need to drink water, so that the straw 11 can be kept bent all the time, which avoids liquid leakage, and the problem of water leakage resulted from displacement and deformation of the upper lid, which are easily resulted from current long-term pressing the upper lid against the straw 11, is solved; and the lid structure in this embodiment is convenient and simple to use, which improves the user experience.

In some implementations, the locking assembly 3 includes a puller 31, a locking pin 32 and a first elastic member 33, the puller 31 is rotatably disposed on an outer wall of the main lid 1, the locking pin 32 is disposed between the main lid 1 and the upper lid 2 in a radially movable manner, one end of the locking pin 32 penetrates out of the main lid 1 and is rotatably connected to the puller 31, and the first elastic member 33 is disposed between the puller 31 and the main lid 1 to drive the locking pin 32 to move inwards along the radial direction.

In this embodiment, the locking assembly 3 includes the puller 31, the locking pin 32 and the first elastic member 33. The puller 31 is rotatably disposed on the outer wall of the main lid 1, and the puller 31 may be rotatably disposed on the outer wall of the main lid 1 through a second hinge pin 35. The locking pin 32 is disposed between the main lid 1 and the upper lid 2 in a radially movable manner, one end of the locking pin 32 penetrates out of the main lid 1 and is rotatably connected to the puller 31, and the locking pin 32 may be rotatably connected to the puller 31 through a first hinge pin 34. The first elastic member 33 is disposed between the puller 31 and the main lid 1 and may drive the locking pin 32 to move inwards along the radial direction, so that the locking assembly 3 moves along the radial direction of the main lid 1 when the straw 11 is bent. The locking pin 32 of the locking assembly 3 is inserted and locked with the inserting and locking portion 151 to prevent the straw 11 from bouncing to be upright. When the puller 31 is pressed, the puller 31 forces the locking pin 32 to move outwards along the radial direction while rotating around the outer wall of the main lid 1, so that the locking pin 32 is separable from the inserting and locking portion so as to be unlocked 151 to achieve one-button opening for drinking water.

In some implementations, a first buckling member 15 and a second buckling member 16 are buckled on the periphery of the straw 11, the inserting and locking portion 151 is disposed on the first buckling member 15 or the second buckling member 16, is located on a side, facing the puller 31, of the straw 11, and is provided with an inserting hole 152, when the straw 11 is bent, the locking pin 32 is inserted and locked in the inserting hole 152 along a radial direction of the main lid 1, and when the puller 31 is pressed, the locking pin 32 is withdrawn from the inserting hole 152.

In this embodiment, the first buckling member 15 and the second buckling member 16 are buckled on the periphery of the straw 11, and the inserting and locking portion 151 is disposed on the first buckling member 15 or the second buckling member 16 and is located on the side, facing the puller 31, of the straw 11. Specifically, when the first buckling member 15 is located on a side, facing the puller 31, of the straw 11, the inserting and locking portion 151 is disposed on the first buckling member 15; and when the second buckling member 16 is located on the side, facing the puller 31, of the straw 11, the inserting and locking portion 151 is disposed on the second buckling member 16. The inserting and locking portion 151 is provided with the inserting hole 152. In this embodiment, when the straw 11 is bent, firstly, the inserting and locking portion 151 abuts against the locking pin 32 to force the locking pin 32 to move outwards along the radial direction of the main lid 1. When the locking pin 32 is aligned to the inserting hole 152 of the inserting and locking portion 151, by means of the first elastic member 33, the locking pin 32 may be inserted and locked in the inserting hole 152 along the radial direction of the main lid 1 to prevent the straw 11 from bouncing to be upright. When the puller 31 is pressed, the locking pin 32 is withdrawn from the inserting hole 152 to achieve one-button opening for drinking water. The structure is simple and reliable, convenient to achieve.

The locking pin 32 may specifically include a first subsection 321 and a second subsection 322 which are connected, one end, away from the second subsection 322, of the first subsection 321 penetrates out of the main lid 1 and is rotatably connected to the puller 31, and an end portion, away from the first subsection 321, of the second subsection 322 is provided with a hanging tongue 325. When the straw 11 is bent, firstly, the inserting and locking portion 151 abuts against the hanging tongue 325 of the second subsection 322 of the locking pin 32 to force the locking pin 32 to move outwards along the radial direction of the main lid 1. When the hanging tongue 325 of the second subsection 322 of the locking pin 32 is aligned to the inserting hole 152 of the inserting and locking portion 151, by means of the first elastic member 33, the locking pin 32 may move inwards along the radial direction of the main lid 1, so that the hanging tongue 325 of the second subsection 322 is inserted and locked in the inserting hole 152 to prevent the straw 11 from bouncing to be upright. When the puller 31 is pressed, the locking pin 32 is withdrawn from the inserting hole 152 to achieve one-button opening for drinking water. The structure is simple and reliable, convenient to achieve.

An end portion, facing the second subsection 322, of the first subsection 321 may be provided with a clamping hook, and an end portion, facing the first subsection 321, of the second subsection 322 may be provided with a locking hole adapted to the clamping hook, so that connection between the first subsection 321 and the second subsection 322 is achieved.

In some implementations, a first rotating shaft 153 is disposed on an outer wall of the first buckling member 15 or the second buckling member 16, the main lid 1 is provided with a first supporting portion 17 extending to the upper lid 2, and an end portion of the first supporting portion 17 and/or the upper lid 2 is provided with a first mounting groove 171 for insertion.

In this embodiment, the first rotating shaft 153 is disposed on the outer wall of the first buckling member 15 or the second buckling member 16, the main lid 1 is provided with the first supporting portion 17 extending to the upper lid 2, the end portion of the first supporting portion 17 and/or the upper lid 2 is provided with the first mounting groove 171 for the first rotating shaft 153 to be inserted, and the first rotating shaft 153 is fixed by the first mounting groove 171, so that the straw 11 is bent when the first buckling member 15 and the second buckling member 16 rotate around the first rotating shaft 153. The structure can ensure a bending position of the straw 11, and then ensures that water leakage can be avoided when the straw 11 is bent. Moreover, the straw 11 is bent in a manner of rotation, so that a bending force is small, liquid leakage resulted from deformation and displacement is avoided, and the sealing effect is improved. The first buckling member 15 and the second buckling member 16 are made of a hard material.

In some implementations, a first hook 154 is disposed on an opening portion, facing to the second buckling member 16, of the first buckling member 15, a second hook 162 is disposed on an opening portion, facing to the first buckling member 15, of the second buckling member 16, and the first hook 154 is hung and locked with the second hook 162.

In this embodiment, the first hook 154 is disposed on the opening portion, facing to the second buckling member 16, of the first buckling member 15, and the second hook 162 is disposed on the opening portion, facing to the first buckling member 15, of the second buckling member 16. By hanging and locking the first hook 154 with the second hook 162, the second buckling member 16 and the first buckling member 15 are buckled. The structure is simple in assembly and increases the assembly efficiency.

In some implementations, a toggle convex edge 161 is disposed on the periphery of the first buckling member 15 or the second buckling member 16, and the toggle convex edge 161 is located on a side, away from the locking assembly 3, of the straw 11 and is located outside the opening 21.

In this embodiment, the toggle convex edge 161 is disposed on the periphery of the first buckling member 15 or the second buckling member 16, and the toggle convex edge 161 is located on the side, away from the locking assembly 3, of the straw 11. Specifically, when the first buckling member 15 is located on a side, away from the puller 31, of the straw 11, the toggle convex edge 161 is disposed on the first buckling member 15; when the second buckling member 16 is located on the side, away from the puller 31, of the straw 11, the toggle convex edge 161 is disposed on the second buckling member 16; and the inserting and locking portion 151 is provided with the inserting hole 152. The toggle convex edge 161 is located outside the opening 21, and therefore, by toggling the toggle convex edge 161, the first buckling member 15 and the second buckling member 16 can rotate, which facilitates bending the straw 11.

The toggle convex edge 161 may also be disposed on the straw 11, at the moment, the toggle convex edge 161 is located on a side, away from the main lid 1, of the second buckling member 16.

In some implementations, the main lid 1 is provided with a protective structure 12, and the protective structure 12 is disposed around the puller 31; and/or, a safety latch 4 is further disposed between the main lid 1 and the upper lid 2, the safety latch 4 is provided with a toggle protrusion 41 protruding out of the upper lid 2, and the locking pin 32 is provided with a locking hole 323 for the safety latch 4 to be inserted and locked when the straw 11 is bent.

In this embodiment, the main lid 1 is provided with a protective structure 12, and the protective structure 12 is disposed around the puller 31, so that the problem of water leakage resulted from moving the locking pin 32 out of the inserting hole 152 as an inner hole in an end portion of the straw 11 when the puller 31 is touched by mistake can be avoided.

The safety latch 4 is further disposed between the main lid 1 and the upper lid 2, the safety latch 4 is provided with the toggle protrusion 41 protruding out of the upper lid 2, and the locking pin 32 is provided with the locking hole 323 for the safety latch 4 to be inserted and locked when the straw 11 is bent. By inserting and locking the safety latch 4 in the locking hole 323, the problem of water leakage resulted from moving the locking pin 32 out of the inserting hole 152 when the puller 31 is touched by mistake can be avoided.

In some implementations, the safety latch 4 is provided with a toggle point 42, the main lid 1 is provided with a first toggle point groove 13 and a second toggle point groove 14; when the safety latch 4 is withdrawn from the locking hole 323, the toggle point 42 is located in the first toggle point groove 13; and when the safety latch 4 is inserted in the locking hole 323, the toggle point 42 is located in the second toggle point groove 14.

In this embodiment, due to the cooperation between the toggle point 42 and each of the first toggle point groove 13 and the second toggle point groove 14, convenience is provided for people to recognize a position, at the same time, the hand feeling is improved, in addition, the problem of water leakage resulted from withdrawing the safety latch 4 out of the locking hole 323 due to waggling and the like is also avoided.

In some implementations, the opening 21 is rotatably provided with a dust cover 5, an opening direction of the dust cover 5 is opposite to a bending direction of the straw 11, the dust cover 5 is provided with a toggle portion 51 abutting against the dust cover when the straw 11 is bent, so as to be matched with the straw 11 to close the opening 21, and the straw 11 and the puller 31 are disposed on two sides of the dust cover 5.

Currently, for lots of water bottle lids in the market, an upper lid is sprang open by a front button, and the water bottle lid is provided with a straw at the rear, which results in inconvenience to drink water. Moreover, mutual interference is caused between opening and drinking water.

In this embodiment, the opening 21 is rotatably provided with the dust cover 5, and the dust cover 5 is provided with the toggle portion 51 abutting against the dust cover when the straw 11 is bent, so as to be matched with the straw 11 to close the opening 21 together. The structure may automatically close the opening 21 when the straw 11 is bent, so that the straw 11 is hidden in the dust cover 5 to avoid entry of dust and the like. In this embodiment, the straw 11 and the puller 31 are disposed on two sides of the dust cover 5. Since an opening direction of the dust cover 5 is opposite to the bending direction of the straw 11, during drinking water, the straw 11 is located in the front, the dust cover 5 is disposed in the middle, and the puller 31 is disposed at the rear. In this embodiment, due to the adoption of a manner that the straw 11 is disposed in the front and the puller 31 is disposed at the rear, it is convenient to drink water, at the same time, no mutual interference is caused between opening and drinking water, so that the opening is easier. Due to the structure that the puller 31 is disposed at the rear, a more convenient and rapider opening manner is achieved.

When the first buckling member 16 and the second buckling member 16 are provided, the straw 11 is bent, and the first buckling member 15 is located on the side, away from the puller 31, of the straw 11, the toggle portion 51 of the dust cover 5 may abut against the first buckling member 15; when the second buckling member 16 is located on the side, away from the puller 31, of the straw 11, the toggle portion 51 of the dust cover 5 may abut against the second buckling member 16; and the dust cover 5 can be forced to close the opening 21 under the two conditions, so that the straw 11 is hidden in the dust cover 5 to avoid entry of dust and the like.

In some implementations, an outer wall of the dust cover 5 is provided with a second rotating shaft 53, a side wall of the opening 21 is provided with a second mounting groove 211, and a second elastic member 53 forcing the dust cover 5 to open the opening 21 is disposed between the main lid 1 and the dust cover 5.

In this embodiment, the second rotating shaft 52 of the dust cover 5 is matched with the second mounting groove 211 in the side wall of the opening 21, so that the dust cover 5 is rotatably fixed on the opening 21. In addition, the second elastic member 53 forcing the dust cover 5 to open the opening 21 is disposed between the main lid 1 and the dust cover 5, and by means of the second elastic member 53, the dust cover 5 is automatically opened when the straw 11 bounces to be upright.

In some implementations, an outer wall of the main lid 1 is provided with a buckling groove 18, and an inner wall of the upper lid 2 is provided with a buckling protrusion 22 buckled in the buckling groove 18; and/or the outer wall of the main lid 1 is provided with an anti-rotation groove 19, and the inner wall of the upper lid 2 is provided with an anti-rotation protrusion 23 inserted in the anti-rotation groove 19.

In this embodiment, the outer wall of the main lid 1 is provided with the buckling groove 18, the inner wall of the upper lid 2 is provided with the buckling protrusion 22 buckled in the buckling groove 18, and the buckling groove 18 and the buckling protrusion 22 are buckled, so that the upper lid 2 is buckled to the main lid 1.

The outer wall of the main lid 1 is provided with the anti-rotation groove 19, and the inner wall of the upper lid 2 is provided with the anti-rotation protrusion 23 inserted in the anti-rotation groove 19. Through cooperation between the anti-rotation groove 19 and the anti-rotation protrusion 23, circumferential rotation between the main lid 1 and the upper lid 2 is prevented, and the buckling groove 18 is prevented from being disengaged from the buckling protrusion 22.

In some implementations, the main lid 1 or the upper lid 2 is rotatably provided with a carry handle 6.

In this embodiment, two ends of the carry handle 6 are rotatably disposed on the outer wall of the main lid 1 or the upper lid 2, which facilitates carrying.

In some implementations, the main lid 1 is provided with an air inlet 10, a plugging valve 7 is disposed on a side, facing the upper lid 2, of the air inlet 10, and when the locking assembly 3 is inserted and locked with the inserting and locking portion 151, the straw 11 is capable of forcing the plugging valve 7 to close the air inlet 10.

Currently, for lots of water bottle lids in the market, the upper lid is closed to press against a plug pin on the straw and a nipple to block an exhaust hole. However, such a type of exhaust hole in the market achieves water sealing in a manner of the plug pin, which will result in water leakage due to closing out of place, and water seepage can also occur on the exhaust hole made of silicon rubber if the plug pin is used for a long term.

In this embodiment, the main lid 1 is provided with the air inlet 10, and a plugging valve 7 is disposed on the side, facing the upper lid 2, of the air inlet 10. In this embodiment, when the locking assembly 3 is inserted and locked with the inserting and locking portion 151, the straw 11 is capable of forcing the plugging valve 7 to close the air inlet 10 by bending itself, so that the air inlet 10 is automatically closed when the dust cover 5 is closed. The inserting and locking portion 151 can ensure that the straw 11 does not bounce when bent here. Therefore, the structure is better in water sealing effect and incapable of resulting from the problem such as water leakage due to closing out of place and water seepage on the exhaust hole made of silicon rubber if the plug pin is used for a long term.

Interference may be generated between each of the air inlet 10 and the plugging valve 7 and the locking latch 32, and therefore, the second subsection 322 is provided with an avoidance hole 324 opposite to the air inlet 10 to avoid the interference generated between each of the air inlet 10 and the plugging valve 7 and the locking latch 32.

In some implementations, a mounting pipe 20 surrounding the air inlet 10 is disposed on a side, facing the upper lid 2, of the main lid 1, the plugging valve 7 includes a plugger 71, a clamping portion 72 and a third elastic member 73, an inner wall of the mounting pipe 20 is provided with an annular blocking portion 201, the clamping portion 72 and the plugger 71 are connected and are sequentially mounted in the mounting pipe 20 from an opening portion away from the main lid 1, the third elastic member 73 is clamped between the clamping portion 72 and the main lid 1, an annular hanging portion 721 is disposed on the periphery of the clamping portion 72 and is located on a side, facing the main lid 1, of the annular blocking portion 201, and an external diameter of the annular hanging portion 721 is greater than an internal diameter of the annular blocking portion 201.

In this embodiment, since the clamping portion 72 the plugger 71 are connected, and the third elastic member 73 is clamped between the clamping portion 72 and the main lid 1 and may specifically sleeve the plugger 71, when the straw 11 bounces to be upright, the third elastic member 73 is capable of forcing the clamping portion 72 of the plugging valve 7 to drive the plugger 71 to open the air inlet 10, and is capable of automatically opening the air inlet 10 when the dust cover 5 is opened, and automatically losing the air inlet 10 when the dust cover 5 is closed. In addition, since the annular hanging portion 721 is disposed on the side, facing the main lid 1, of the annular blocking portion 201, and the external diameter of the annular hanging portion 721 is greater than the internal diameter of the annular blocking portion 201, by limiting the annular hanging portion 721 and the annular blocking portion 201, the clamping portion 72 of the plugging valve 7 can be clamped in the mounting pipe 20 to avoid water leakage of the air inlet 10 due to the falling off of the plugging valve 7.

In some implementations, an end portion, facing the main lid 1, of the clamping portion 72 is provided with an inserting pipe 722, the annular hanging portion 721 is disposed on the periphery of the inserting pipe 722, the inserting pipe 722 is provided with a plurality of shrinkage grooves 723 extending in an axial direction, the shrinkage grooves 723 extend from an end portion, facing the main lid 1, of the inserting pipe 722 to a side, away from the main lid 1, of the annular hanging portion 721, and the shrinkage grooves 723 penetrate through the annular hanging portion 721.

In this embodiment, the end portion, facing the main lid 1, of the clamping portion 72 is provided with the inserting pipe 722, the inserting pipe 722 is provided with the shrinkage grooves 723, which facilitates inward shrinkage of the annular hanging portion 721 during assembly, so that the annular hanging portion 721 is clamped on a side, facing the main lid 1, of the annular blocking portion 201, which increases the assembly efficiency.

An embodiment of present disclosure further provides a water bottle. The water bottle includes the lid structure as described above.

The lid structure may be screwed with a water bottle body through threads, and a sealing gasket may be disposed between the lid structure and the water bottle body to avoid liquid leakage.

In summary, it is readily understood by those skilled in the art that the above advantageous technical features can be freely combined and superimposed without conflicts.

The above description is merely specific implementations of the present disclosure, and is not intended to limit the scope of protection of the present disclosure. All equivalent modifications or substitutions which may be easily conceived by those skilled in the art within the technical scope disclosed by the present disclosure shall fall within the scope of protection of the present disclosure. Therefore, the scope of protection of the present disclosure shall be based on the scope of protection of the claims.

The invention claimed is:

1. A lid structure, comprising:

a main lid (1) provided with a straw (11), an inserting and locking portion (151) being disposed on a side wall of the straw (11);

an upper lid (2) buckled to the main lid (1), the upper lid (2) being provided with an opening (21) for the straw (11) to extend out; and a locking assembly (3) disposed between the main lid (1) and the upper lid (2), wherein when the straw (11) is bent, the locking assembly (3) is capable of moving along a radial direction of the main lid (1) to be inserted and locked with the inserting and locking portion (151), and the locking assembly (3) is separable from the inserting and locking portion so as to be unlocked (151) when pressed;

wherein the locking assembly (3) comprises a puller (31), a locking pin (32) and a first elastic member (33), the puller (31) is rotatably disposed on an outer wall of the main lid (1), the locking pin (32) is disposed between the main lid (1) and the upper lid (2) in a radially movable manner, one end of the locking pin (32) penetrates out of the main lid (1) and is rotatably connected to the puller (31), and the first elastic member (33) is disposed between the puller (31) and the main lid (1) to drive the locking pin (32) to move inwards along the radial direction.

2. The lid structure according to claim 1, wherein a first buckling member (15) and a second buckling member (16) are buckled on the periphery of the straw (11), the inserting and locking portion (151) is disposed on the first buckling member (15) or the second buckling member (16), is located on a side, facing the puller (31), of the straw (11), and is provided with an inserting hole (152), when the straw (11) is bent, the locking pin (32) is inserted and locked in the inserting hole (152) along a radial direction of the main lid (1), and when the puller (31) is pressed, the locking pin (32) is withdrawn from the inserting hole (152).

3. The lid structure according to claim 2, wherein a first rotating shaft (153) is disposed on an outer wall of the first buckling member (15) or the second buckling member (16), the main lid (1) is provided with a first supporting portion (17) extending to the upper lid (2), and an end portion of the first supporting portion (17) and/or the upper lid (2) is provided with a first mounting groove (171) for the first rotating shaft (153) to be inserted.

4. The lid structure according to claim 2, wherein a first hook (154) is disposed on an opening portion, facing to the second buckling member (16), of the first buckling member (15), a second hook (162) is disposed on an opening portion, facing to the first buckling member (15), of the second buckling member (16), and the first hook (154) is hung and locked with the second hook (162); and/or a toggle convex edge (161) is disposed on the periphery of the first buckling member (15) or the second buckling member (16), and the toggle convex edge (161) is located on a side, away from the locking assembly (3), of the straw (11) and is located outside the opening (21).

5. The lid structure according to claim 1, wherein the main lid (1) is provided with a protective structure (12), and the protective structure (12) is disposed around the puller (31);

and/or, a safety latch (4) is further disposed between the main lid (1) and the upper lid (2), the safety latch (4) is provided with a toggle protrusion (41) protruding out of the upper lid (2), and the locking pin (32) is provided with a locking hole (323) for the safety latch (4) to be inserted and locked when the straw (11) is bent.

6. The lid structure according to claim 1, wherein the opening (21) is rotatably provided with a dust cover (5), an opening direction of the dust cover (5) is opposite to a bending direction of the straw (11), the dust cover (5) is provided with a toggle portion (51) abutting against the dust cover when the straw (11) is bent, so as to be matched with the straw (11) to close the opening (21), and the straw (11) and the puller (31) are disposed on two sides of the dust cover (5).

7. The lid structure according to claim 1, wherein the main lid (1) is provided with an air inlet (10), a plugging valve (7) is disposed on a side, facing the upper lid (2), of the air inlet (10), and when the locking assembly (3) is inserted and locked with the inserting and locking portion (151), the straw (11) is capable of forcing the plugging valve (7) to close the air inlet (10).

8. The lid structure according to claim 7, wherein a mounting pipe (20) surrounding the air inlet (10) is disposed on a side, facing the upper lid (2), of the main lid (1), the plugging valve (7) comprises a plugger (71), a clamping portion (72) and a third elastic member (73), an inner wall of the mounting pipe (20) is provided with an annular blocking portion (201), the clamping portion (72) and the plugger (71) are connected and are sequentially mounted in the mounting pipe (20) from an opening portion away from the main lid (1), the third elastic member (73) is clamped between the clamping portion (72) and the main lid (1), an annular hanging portion (721) is disposed on the periphery of the clamping portion (72) and is located on a side, facing the main lid (1), of the annular blocking portion (201), and an external diameter of the annular hanging portion (721) is greater than an internal diameter of the annular blocking portion (201).

9. The lid structure according to claim 8, wherein an end portion, facing the main lid (1), of the clamping portion (72) is provided with an inserting pipe (722), the annular hanging portion (721) is disposed on the periphery of the inserting pipe (722), the inserting pipe (722) is provided with a plurality of shrinkage grooves (723) extending in an axial direction, the shrinkage grooves (723) extend from an end portion, facing the main lid (1), of the inserting pipe (722) to a side, away from the main lid (1), of the annular hanging portion (721), and the shrinkage grooves (723) penetrate through the annular hanging portion (721).

10. A lid structure, comprising:

a main lid (1) provided with a straw (11), an inserting and locking portion (151) being disposed on a side wall of the straw (11);

an upper lid (2) buckled to the main lid (1), the upper lid (2) being provided with an opening (21) for the straw (11) to extend out; and a locking assembly (3) disposed between the main lid (1) and the upper lid (2), wherein when the straw (11) is bent, the locking assembly (3) is capable of moving along a radial direction of the main lid (1) to be inserted and locked with the inserting and locking portion (151), and the locking assembly (3) is separable from the inserting and locking portion so as to be unlocked (151) when pressed;

wherein the main lid (1) is provided with an air inlet (10), a plugging valve (7) is disposed on a side, facing the upper lid (2), of the air inlet (10), and when the locking assembly (3) is inserted and locked with the inserting and locking portion (151), the straw (11) is capable of forcing the plugging valve (7) to close the air inlet (10).

11. The lid structure according to claim 10, wherein a mounting pipe (20) surrounding the air inlet (10) is disposed on a side, facing the upper lid (2), of the main lid (1), the plugging valve (7) comprises a plugger (71), a clamping portion (72) and a third elastic member (73), an inner wall of the mounting pipe (20) is provided with an annular blocking portion (201), the clamping portion (72) and the plugger (71) are connected and are sequentially mounted in the mounting pipe (20) from an opening portion away from the main lid (1), the third elastic member (73) is clamped between the clamping portion (72) and the main lid (1), an annular hanging portion (721) is disposed on the periphery of the clamping portion (72) and is located on a side, facing the main lid (1), of the annular blocking portion (201), and an external diameter of the annular hanging portion (721) is greater than an internal diameter of the annular blocking portion (201).

12. The lid structure according to claim 11, wherein an end portion, facing the main lid (1), of the clamping portion (72) is provided with an inserting pipe (722), the annular hanging portion (721) is disposed on the periphery of the inserting pipe (722), the inserting pipe (722) is provided with a plurality of shrinkage grooves (723) extending in an axial direction, the shrinkage grooves (723) extend from an end portion, facing the main lid (1), of the inserting pipe (722) to a side, away from the main lid (1), of the annular hanging portion (721), and the shrinkage grooves (723) penetrate through the annular hanging portion (721).

* * * * *